US006808446B1

(12) United States Patent
Mosier

(10) Patent No.: US 6,808,446 B1
(45) Date of Patent: Oct. 26, 2004

(54) ABRASIVE FLAP DISC

(75) Inventor: Paul Mosier, Swadlincote (GB)

(73) Assignee: Elliott Industries Limited, London (GB)

( * ) Notice: Subject to any disclaimer, the term of this patent is extended or adjusted under 35 U.S.C. 154(b) by 0 days.

(21) Appl. No.: 10/018,330

(22) PCT Filed: Apr. 25, 2000

(86) PCT No.: PCT/GB00/01582

§ 371 (c)(1),
(2), (4) Date: Oct. 23, 2001

(87) PCT Pub. No.: WO01/05556

PCT Pub. Date: Jan. 25, 2001

(30) Foreign Application Priority Data

Apr. 23, 1999 (GB) ..... 9909468

(51) Int. Cl.[7] ..... B24B 13/06

(52) U.S. Cl. ..... 451/466; 451/468; 451/524; 451/533

(58) Field of Search ..... 451/344, 468, 451/469, 486, 463, 464, 465, 466, 487, 490, 523, 524, 525, 533, 539; 15/230; 26/28

(56) References Cited

U.S. PATENT DOCUMENTS

| | | | | | |
|---|---|---|---|---|---|
| 1,654,275 | A | | 12/1927 | Strand | |
| 2,907,145 | A | * | 10/1959 | Hall et al. | 451/468 |
| 3,486,276 | A | | 12/1969 | Block | |
| 3,706,167 | A | * | 12/1972 | Schaffner | 451/466 |
| 4,441,349 | A | * | 4/1984 | Symons | 451/465 |
| 4,872,292 | A | | 10/1989 | Block | |
| 4,961,807 | A | | 10/1990 | Ichiguchi | 156/261 |
| 5,871,399 | A | * | 2/1999 | Emerson | 451/466 |
| 6,506,100 | B2 | * | 1/2003 | Blattler | 451/44 |

FOREIGN PATENT DOCUMENTS

| | | | | |
|---|---|---|---|---|
| DE | 2411749 A1 | | 9/1975 | |
| DE | 100 15418 A1 | * | 12/2000 | |
| EP | 0 212 062 A1 | | 4/1986 | B24D/9/00 |
| EP | 0 922 535 B1 | | 4/2002 | |
| FR | 2127897 | | 10/1972 | B24B/23/00 |
| GB | 1147915 | | 4/1969 | B24D/13/02 |
| GB | 2 138 334 A | | 10/1984 | B24D/13/04 |
| GB | 2 270 487 A | | 3/1994 | B24D/13/04 |

* cited by examiner

*Primary Examiner*—Timothy V. Eley
(74) *Attorney, Agent, or Firm*—Kilyk & Bowersox, P.L.LC.

(57) ABSTRACT

The invention relates to abrasive flap discs which are used for a variety of finishing, grinding and polishing operations, particularly on welded fabrications. The present invention provides an abrasive flap disc (20) comprising a backing plate (11), an annular array of flaps (12) of abrasive material arranged on the backing plate (11) and bonded thereto along the lower most edge of each flap (12), wherein each flap (12), at least in a radially outer region is substantially spaced from each adjacent flap (12) such that the flaps (12) have freedom to flex and conform to an underlying surface in use.

27 Claims, 3 Drawing Sheets

ABRASIVE FLAP DISC

The invention relates to abrasive flap discs which are used for a variety of finishing, grinding and polishing operations, particularly on welded fabrications.

Generally, flap discs comprise a relatively stiff backing plate onto which abrasive flaps are adhered. The backing plate can be angled, flat, depressed, raised, or a combination of these variations. They are typically 4"–9" (10.16 cm–22.86 cm) in diameter, although smaller diameter discs are being introduced. The abrasives used are ordinarily 24–120 grit.

There are alternatives to flap discs, such as Depressed Centre (resin bonded) Grinding Wheels (DCGWs). However, these are only suitable for removing large amounts of material and generally can not provide suitable finishing. Thus, the use of Sanding Discs (SDs) is required subsequent to the grinding operation. Unlike these two aforementioned counterparts, flap discs are multi-purpose, this being partly attributable to the fact that the surface operation performed by them is somewhat dependent upon the pressure applied by the operator.

Furthermore, the superior properties of flap discs over DCGWs are attributable to the fact that flap discs use coated abrasives (unlike bonded abrasives for a DCGW), which inherently present the majority of the abrasive grit particles at their optimum cutting attitude whilst providing a potentially "softer" operation, removing material at a variable rate dependent upon the pressure applied and contributing to an improved surface finish. Flap discs are also considered superior to SDs due to the use of multi-layer coated abrasives, which provide a substantially greater amount of useable abrasive cloth, in the region of 20:1, to provide a substantially longer life for the flap discs.

Although flap discs are "softer" than DCGWs, flap discs are still "hard", particularly when finer grit sizes are used, and as such do not lend themselves to contouring or blending work. There have been moves to develop flap discs which are "softer", but these have concentrated on providing a backing plate with reduced stiffness, e.g. Zircotex (RTM). In such cases, this has not been wholly successful as the necessary combination of a "flexible" disc and "support pad" have proved to be too rigid. Thus, the operational range of these flap discs are significantly limited. Moreover, the configuration of flap discs prevents them from being capable of dressing sharp corners.

The present invention provides an abrasive flap disc comprising a backing plate, an annular array of flaps of abrasive material arranged on the backing plate and bonded thereto along the lowermost edge of each flap, wherein each flap, at least in a radially outer region, is substantially spaced from each adjacent flap such that the flaps have freedom to flex and conform to an underlying surface in use.

Preferably, each flap does not contact an adjacent flap at all. Alternatively, each flap contacts an adjacent flap along its radially inner edge.

Preferably, the angle between the backing plate and each flap is in the range of approximately 20° to approximately 90°. Advantageously, the angle between the backing plate and each flap is in the range of approximately 40° to approximately 70°.

In one embodiment, the abrasive flaps of the disc may be arranged such that a centerline of each flap, which extends between its radially inner and outer edges, is substantially on a radius of the backing plate.

Alternatively, the centerline of each flap may be at an angle to a radius of the backing plate. Advantageously, the angle between each flap centerline and a radius of the backing plate is in the range of approximately between 5° to approximately 85°. Most preferably, the angle between each flap centerline and a radius of the backing plate is in the range of approximately between 30° to approximately 60°.

Preferably, the flaps comprise abrasive grit bonded to a backing material and the backing plate includes means to attach the disc to a drive mechanism.

The invention further provides a method of producing an abrasive flap disc of the type described above, comprising the steps of providing a backing plate, providing an adhesive on an upper surface of the backing plate; rotating the backing plate incrementally; at each incremental step, feeding the end of a strip of abrasive material on to the adhesive on the backing plate; severing the end of the strip to form a flap repeating the process until an annular array of flaps is formed on the backing plate with each flap, at least in a radially outer region, being spaced from each adjacent flap, maintaining the flaps in the spaced position; and curing the adhesive to secure the flaps to the backing plate.

Preferably, after constructing the array of flaps and before curing, the method further includes the step of placing the disc in a former adapted to prevent each flap falling into substantial contact with an adjacent flap.

The former may include a cylindrical wall dimensioned to encircle the disc and prevent each flap falling into substantial contact with an adjacent flap. Alternatively, a spoke-shaped frame may be placed with a spoke positioned between adjacent flaps, to prevent each flap falling into substantial contact with an adjacent flap.

In one embodiment, the strip of abrasive material is fed such that each flap has a centerline extending from its radially inner to outer edge which is substantially on a centerline of the backing plate.

Alternatively, the strip of abrasive material may be fed such that each flap has a centerline extending from its radially inner to outer edge which is at an angle to a radius of the backing plate.

The invention therefore provides flap discs having an arrangement of abrasive flaps which give the flaps pliability and increased-freedom to flex and conform to an underlying surface, thereby increasing the applicability of flap discs whilst maintaining sufficient support for the abrasive flaps such that the operational range of the abrasive flap discs is also maintained. Specifically, the flap disc operator can use a single tool to perform a number of functions, efficiently controlling the operation performed by the pressure and angle of approach applied to the tool. Moreover, the arrangement of abrasive flaps provided is still sufficiently stiff such that the grinding of particularly rough surfaces is possible. In particular, the flap discs of this invention can be used in contour and blending work, and also to dress sharp corners.

It is recognised that there are other processes for the manufacture of flap discs which differ in specific ways from the normal process referred to above. However the invention is valid regardless of how the cloth and flaps are presented, cut or adhered to the backing plate.

The invention will now be described in detail, by way of example only, with reference to the following drawings in which.

Figure 3:
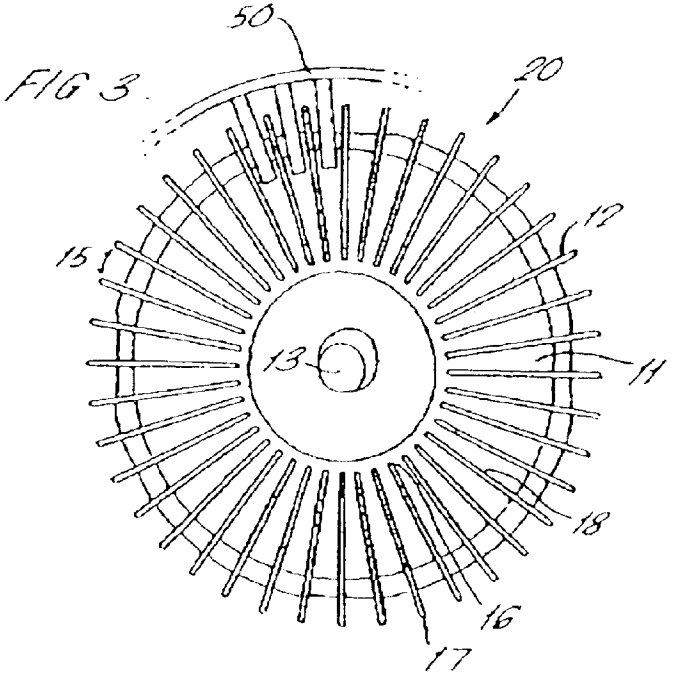
FIG. 3 is plan view of a flap disc in accordance with one embodiment of the present invention, in which the centerlines of the abrasive flaps are aligned with radii of the backing plate.
Figure 4:
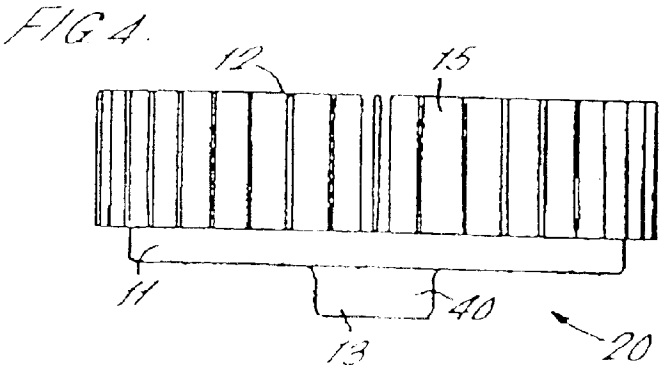
FIG. 4 is a side view of the flat disc of FIG. 3.
Figure 1:
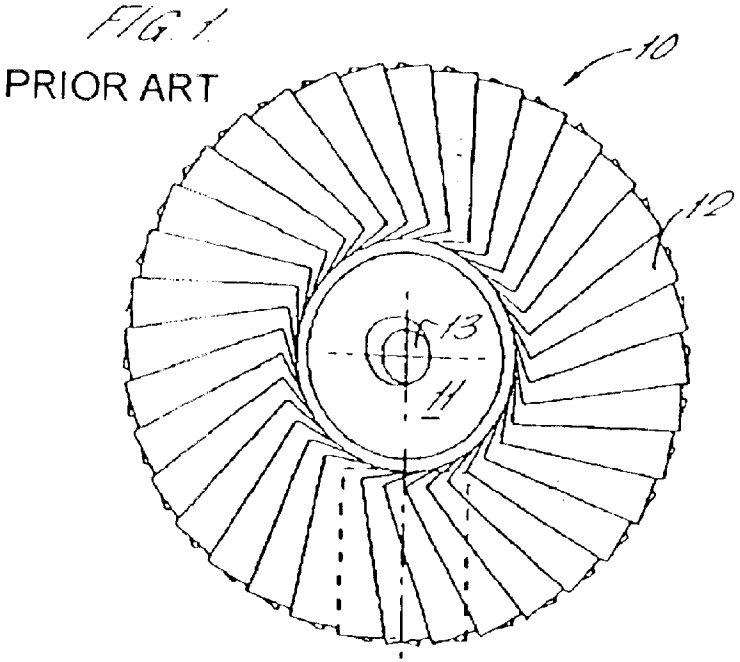
FIG 1. PRIOR ART
FIG. 1 is a plan view of a typical flap disc.
Figure 2:
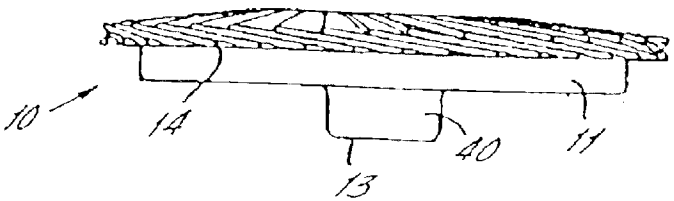
FIG 2. PRIOR ART
FIG. 2 is a side view of the flap disc of FIG. 1.

As can be seen from FIGS. 1 and 2, current flap discs 10 comprise a backing plate 11 around the perimeter of which are arranged abrasive flaps 12. In addition, the backing plate 11 comprises a central hole 13, which is used to locate the flap disc 10 to a drive mechanism (not shown). Of course, the hole 13 can be used to locate the flap disc 10 on any suitably sized guide pin e.g. during manufacture or storage, allowing several flap discs 10 to be stacked one upon another. The backing plate 11 may comprise a projection 40 (in addition to or instead of a hole 13) on the reverse side of the backing plate 11 to allow connection to the drive mechanism.

Although the backing plate 11 is shown to be flat in FIG. 2, the backing plate 11 can be a variety of shapes including inclined from the central hole 13, depressed or raised around the central hole 13, or some combination of these.

The abrasive flaps 12 themselves comprise an abrasive grit applied to a backing material such as denim. Generally, the abrasive flaps 12 are rectangular in shape and are attached along one edge to the backing plate 11 using a single epoxy adhesive 14. The abrasive flaps 12 are usually cut to size from a long strip of material during manufacture of the flap disc 10.

Current practice is to apply the adhesive 14 onto the backing plate 11 over the region on which the abrasive flaps 12 will be positioned. The backing plate 11 is then rotated incrementally, and at each increment the end of a long strip of abrasive material is fed at an angle onto the glued region of the backing plate 11, and the end part is then cut off to form a single flap. This process is repeated until the required number of flaps 12 have been applied to the backing plate 11.

Typically, this semi-manufactured abrasive flap disc 10 is then stacked upon another semi-manufactured abrasive flap disc 10. On occasion, a former may be used to separate the two semi-manufactured abrasive discs 10. The former is generally a disc of material which mirrors the contour of the required abrasive face of the disc, and is used to apply a restraining pressure over part or the entire area over which the abrasive flaps 12 have been arranged. In particular, formers can be particularly useful when the outer face of the abrasive flaps 12 are required to be at a different angle to the angle of the back face of the backing plate 11.

The purpose of stacking the semi-manufactured flaps discs 10 is to flatten each of the abrasive flaps 12 onto one another so that the back surface of each abrasive flap 12 rests upon the front abrasive surface of each corresponding adjacent abrasive flap 12. Any suitable means which produce such flattened abrasive flaps 12 can be employed e.g. not just by stacking but by applying external pressure to each of the individual flap discs 10.

Once flattened, the stack of abrasive discs 10 is normally placed into an oven to cure the epoxy 14 such that it binds the abrasive flaps 12 in the flattened position onto the backing plates 11.

Current practice is to arrange the flaps 12 such that their respective centerlines are aligned with radii of the backing plate 11. This produces a square hard edge which is desirable in some operations.

It is clear that, if a larger number of flaps 12 is to be applied to the flap disc 10, then the flaps 12 will be increasingly upright. However, the flaps 12 are always flattened as far as possible so as to rest upon one another.

In contrast, flap discs 20 in accordance with two embodiments of this invention are shown in FIGS. 3–6. The flaps 12 are positioned substantially upright such that there are significant gaps 15 between the abrasive flaps 12. Preferably, in the abrasive flap discs 20 of the present invention, the angle between the backing plate 11 and abrasive flap 12 is between 20°–90°. More specifically, the angle between the backing plate 11 and abrasive flap 12 is between 40°–70°. With conventional flap discs, the angle of the flaps relative to the backing plate depends upon the number of flaps, as referred to above. With the flap discs of the present invention, however, the flaps are spaced from one another and hence the angle between the flaps and the backing plate is not dictated by the number of flaps.

Generally, each adjacent flap 12 does not rest upon it neighbour at all. However, it may be useful to arrange the flaps 12 such that adjacent flaps 12 do touch one another along their respective inner edges 16. This provides some support for the flaps 12 during curing. This contact can of course be line or point contact.

This relatively upright, open, arrangement of flaps 12 gives the flaps 12 increased flexibility, particularly at the outer periphery of the flap disc 20, and allows the flaps 12 to conform to an underlying surface in use. Thus, the operator is provided with the ability of aggressive, heavy cutting or light contour blending. It is therefore suitable to dress sharp corners, and can be used also for blending and contouring work.

As mentioned above, conventional flap discs 10 are manufactured with the flap centre line, which extends radially from the inner edge 16 to outer edge 17 of the flap 12, lying approximately on a diameter of the disc 10 (as best seen in FIG. 1). In the first embodiment of the present invention, shown in FIGS. 3 and 4, the flaps 12 are also positioned in this way.

Figure 5:
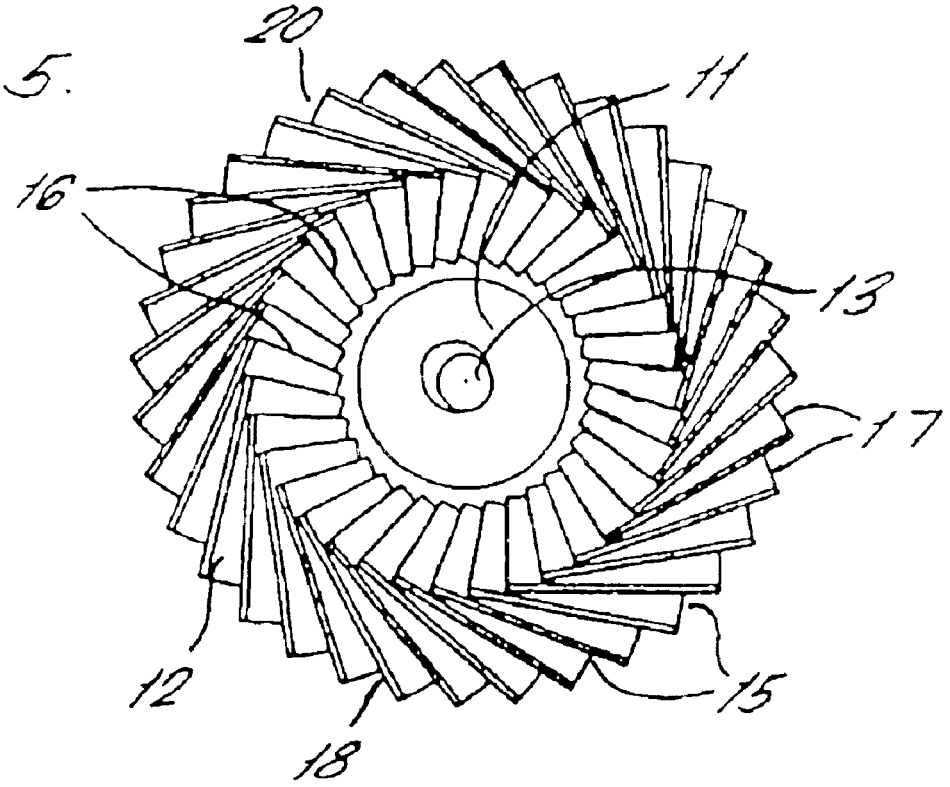
FIG. 5 is a plan view of a flap disc in accordance with a second embodiment of the present invention, in which the centerlines of the abrasive flaps are arranged at an angle to radii of the backing plate.
Figure 6:
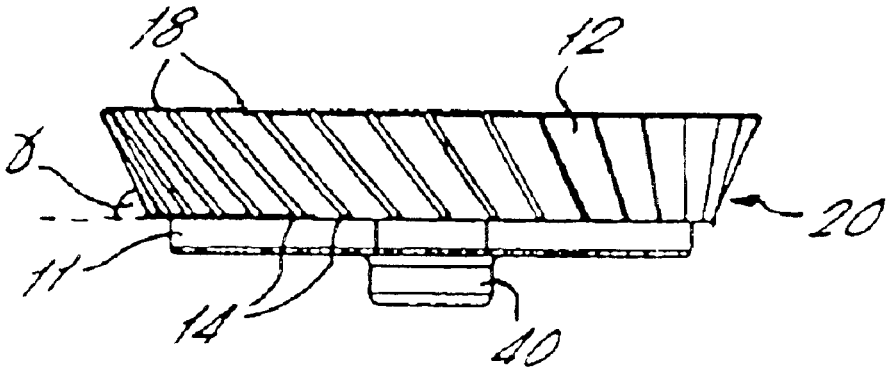
FIG. 6 is a side view of the flap disc of FIG. 5.

Alternatively, in a second embodiment, shown in FIGS. 5 and 6, the flaps 12 are displaced such that the flap centre line lies at an angle to a radius of the disc. This helps to provide an arrangement of self supporting flaps in which the inner edge 16 of each flap rests on its neighbour. Thus, the flaps 12 of this arrangement can be cured without the need for a former (described below) to hold the flaps 12 up. Preferably, in the abrasive flap discs 20 of the current invention, the angle between the flap centerline and the radius of the backing plate is between 5°–85°. More specifically, the angle between the flap centerline and the radius of the backing plate is between 30°–60°. This feature of the invention provides an additional benefit to the product, which is the resulting generation of angle $\gamma$ (see FIG. 6) which provides the added facility to dress and blend sharp internal corners.

The flap discs 20 of the present invention may be manufactured using a similar process to that described above for conventional flap discs, except that adjacent flaps 12 are not flattened onto one another. Following arrangement of the appropriate number of abrasive flaps 12 onto the backing plate 11, the flaps 12 are left in a substantially upright position, spaced from one another (except perhaps along their inner edges 16). The semi-manufactured flap discs 20 may then be placed directly into ovens to cure the adhesive 14, or they may be placed in specially designed formers 30 (shown in FIGS. 7 and 8) to keep the abrasive flaps 12 upright and spaced apart. These formers 30 also function to enable stacking of a number of flap discs 20.

Figure 7:
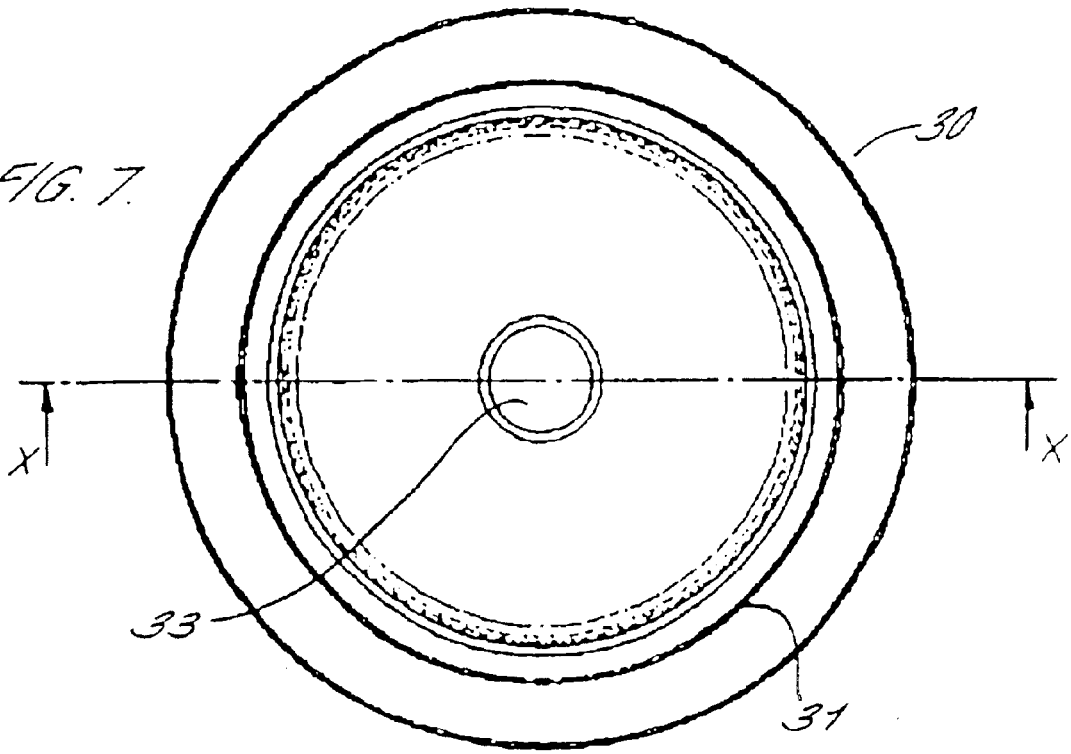
FIG. 7 is a plan view of a former used in the manufacturing process of the flap disc of the present invention.
Figure 8:
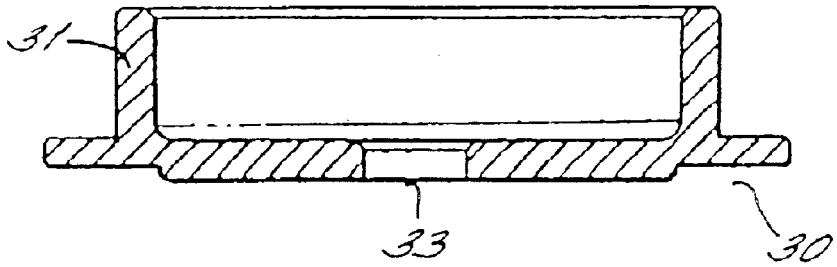
FIG. 8 is a cross sectional view through the former of FIG. 7 along line X—X.

The formers 30 are typically made from pressed steel or aluminium, but can be made from a variety of different materials e.g. those materials which have sufficient stiffness, which can be easily and cost effectively manufactured into the required shapes, and/or which have appropriate heat resistant and thermal expansivity properties. A particular embodiment of a former 30 is illustrated in FIGS. 7 and 8, and shows a former 30 having a cylindrical wall 31 dimensioned to encircle the abrasive flap discs and support the flaps.

During manufacture, the projection 40 of the backing plate 11 can be placed in the centre hole 33 of the former and thus locates the semi-manufactured flap disc 20 within the former 30. In such a position, contact between the former side wall 31 and the outer edges 17 of the laps 12 provides support for flaps 12. In addition, the height of the side wall 31 is greater than the height of the flap disc 20 and is therefore sufficient to allow stacking of a number of semi-manufactured flap discs 20 contained within their respective formers 30. It is important that pressure must not be applied to the top edge 18 of the flaps 12 such that they become flattened. For additional support, a substantially spoke-shaped frame 50 could be appropriately positioned in the former 20, with spokes protruding into the gaps 15, between adjacent flaps 12, so as to support the flaps 12 during curing and prevent them falling back into contact with adjacent flaps. Formers with different configurations can be used so long as they perform the above mentioned functions.

In summary, the process used to produce flap discs in accordance with this invention holds the flaps up and thus provides abrasive flaps which are substantially upright, with gaps or openings between the adjacent flaps. The flap discs of the present invention are more flexible than conventional discs, enabling them to be used in contour and blending work, and also to dress into sharp corners, and thus increases the usefulness of flap discs.

What is claimed is:

1. An abrasive flap disc comprising:

a disc-shaped backing plate, and an annular array of flaps of abrasive material arranged on the backing plate and bonded thereto along an edge of each flap which extends from a radially inner to a radially outer part of the backing plate, wherein each flap at least in a radially outer region, is substantially spaced from each adjacent flap with no element therebetween such that the flaps have freedom to flex and conform to an underlying surface in use.

2. An abrasive flap disc as claimed in claim 1, wherein each flap does not contact an adjacent flap at all.

3. An abrasive flap disc as claimed in claim 1, wherein each flap contacts an adjacent flap along its radially inner edge.

4. An abrasive flap disc as claimed in claim 1, wherein an angle between the backing plate and each flap is in the range of approximately 20° to approximately 90°.

5. An abrasive flap disc as claimed in claim 4, wherein the angle between the backing plate and each flap is in the range of approximately 40° to approximately 70°.

6. An abrasive flap disc as claimed in claim 1, wherein a center line of each flap, which extends between its radially inner and outer edges, is substantially parallel to a radius of the backing plate.

7. An abrasive flap disc as claimed in claim 1, wherein a centerline of each flap, which extends between its radially inner and outer edges, is at an angle relative to a radius of the backing plate.

8. An abrasive flap disc as claimed in claim 7, wherein an angle between each flap center line and a radius of the backing plate is in the range of approximately between 5° to approximately 85°.

9. An abrasive flap disc as claimed in claim 8, wherein the angle between each flap center line and a radius of the backing plate is in the range of approximately between 30° to approximately 60°.

10. An abrasive flap disc as claimed in claim 1, wherein the flaps comprise abrasive grit bonded to a backing material.

11. An abrasive flap disc as claimed in claim 1, wherein the backing plate includes means to attach the disc to a drive mechanism.

12. A method of producing an abrasive flap disc of the type set out in claim 1, comprising the steps of:

providing a disc-shaped backing plate;

providing an adhesive on a surface of the backing plate;

rotating the backing plate incrementally, at each incremental step, feeding the end of a strip of abrasive material on to the adhesive on the backing plate;

severing the end of the strip to form a flap;

repeating the steps of rotating, feeding and severing until an annular array of flaps is formed on the backing plate with each flap at least in a radially outer region, being spaced from each adjacent flap;

maintaining the flaps in the spaced position, and curing the adhesive to secure the flaps to the backing plate.

13. A method of producing an abrasive flap disc as claimed in claim 12, wherein after constructing the array of flaps and before curing, the method further includes the step of placing the disc in a former adapted to prevent each flap falling into substantial contact with an adjacent flap.

14. A method of producing an abrasive flap disc as claimed in claim 13, wherein the former includes a cylindrical wall dimensioned to encircle the disc and prevent each flap falling substantial contact with an adjacent flap.

15. A method of producing an abrasive flap disc as claimed in claim 13, wherein a spoke-shaped frame is placed with a spoke positioned between adjacent flaps to prevent each flap falling into substantial contact with an adjacent flap.

16. A method of producing an abrasive flap disc as claimed in claim 12, comprising the step of feeding the strip of abrasive material such that each flap has a centerline extending from its radially inner to its radially outer edge which is substantially parallel to a radius of the backing plate.

17. A method of producing an abrasive flap disc as claimed in claim 12, comprising the step of feeding the strip of abrasive material such that each flap has a center line extending from its radially inner to its radially outer edge which is at an angle to a radius of the backing plate.

18. A method of producing an abrasive flap disc, comprising the steps of:

providing a disc-shaped backing plate;

providing an adhesive on an upper surface of the backing plate;

rotating the backing plate incrementally;

at each incremental step, feeding the end of a strip of abrasive material on to the adhesive on the backing plate;

severing the end of the strip to form a flap;

repeating the steps of rotating, feeding and severing until an annular array of flaps is formed on the backing plate with each flap, at least in a radially outer region, being spaced from each adjacent flap;

maintaining the flaps in the spaced position; and curing the adhesive to secure the flaps to the backing plate.

19. A method of producing an abrasive flap disc as claimed in claim 18, wherein after constructing the array of flaps and before curing, the method further includes the step of placing the disc in a former adapted to prevent each flap from falling into substantial contact with an adjacent flap.

20. A method of producing an abrasive flap disc as claimed in claim 18, comprising the step of feeding the strip of abrasive material such that each flap has a center line extending from its radially inner to outer edge and which is at an angle relative to a radius of the tacking plate.

21. An abrasive flap disc comprising:

a disc-shaped backing plate, and an annular array of flaps of abrasive material arranged on the backing plate and bonded thereto along an edge of each flap which extends from a radially inner to a radially outer part of the backing plate, wherein each flap at least in a radially outer region, is substantially spaced from each adjacent flap with no element therebetween such that the flaps have freedom to flex and conform to an underlying surface in use, wherein each flap contacts an adjacent flap on its radially inner edge.

22. A method of producing an abrasive flap disc comprising a disc-shaped backing plate, and an annular array of flaps of abrasive material arranged on the backing plate and bonded thereto along an edge of each flap which extends from a radially inner to a radially outer part of the backing plate, wherein each flap at least in a radially outer region, is substantially spaced from each adjacent flap with no element therebetween such that the flaps have freedom to flex and conform to an underlying surface in use, the method comprising:

providing a disc-shaped backing plate;

providing an adhesive on a surface of the backing plate;

rotating the backing plate incrementally;

at each incremental step, feeding the end of a strip of abrasive material on to the adhesive on the backing plate;

severing the end of the strip to form a flap;

repeating the steps of rotating, feeding and severing until an annular array of flaps is formed on the backing plate with each flap at least in a radially outer region, being spaced from each adjacent flap;

maintaining the flaps in the spaced position; and curing the adhesive to secure the flaps to the backing plate.

23. A method of producing an abrasive flap disc as claimed in claim 22, wherein after constructing the array of flaps and before curing, the method further includes the step of placing the disc in a former adapted to prevent each flap falling into substantial contact with an adjacent flap.

24. A method of producing an abrasive flap disc as claimed in claim 23, wherein the former includes a cylindrical wall dimensioned to encircle the disc and prevent each flap falling substantial contact with an adjacent flap.

25. A method of producing an abrasive flap disc as claimed in claim 23, wherein a spoke-shaped frame is placed with a spoke positioned between adjacent flaps to prevent each flap falling into substantial contact with an adjacent flap.

26. A method of producing an abrasive flap disc as claimed in claim 22, comprising the step of feeding the strip of abrasive material such that each flap has a centerline extending from its radially inner to its radially outer edge which is substantially parallel to a radius of the backing plate.

27. A method of producing an abrasive flap disc as claimed in claim 22, comprising the step of feeding the strip of abrasive material such that each flap has a center line extending from its radially inner to its radially outer edge which is at an angle to a radius of the backing plate.

* * * * *